United States Patent [19]

Gardner

[11] 4,129,076

[45] Dec. 12, 1978

[54] COLOR-KEYED FABRIC FOR SCREEN PRINTING

[76] Inventor: Robert F. Gardner, 5505 Hawthorne Dr., Indianapolis, Ind. 46226

[21] Appl. No.: 858,360

[22] Filed: Dec. 7, 1977

[51] Int. Cl.[2] ..... B41F 15/36

[52] U.S. Cl. ..... 101/127; 101/127.1

[58] Field of Search ..... 101/127, 129, 127.1, 101/128.1; 38/102

[56] References Cited

U.S. PATENT DOCUMENTS

| | | | |
|---|---|---|---|
| 2,299,628 | 10/1942 | Johnson et al. | 101/127 |
| 2,757,607 | 8/1956 | Fordyce | 101/127.1 |
| 3,096,197 | 7/1963 | Buetow et al. | 101/129 X |
| 3,943,851 | 3/1976 | Inada et al. | 101/127.1 |
| 4,041,861 | 8/1977 | Alter | 101/127.1 |

*Primary Examiner*—Ronald E. Suter

*Attorney, Agent, or Firm*—Woodard, Weikart, Emhardt & Naughton

[57] ABSTRACT

Disclosed is a woven, screen printing fabric having spaced horizontal and vertical groups of threads or fibers provided with a color contrasting with the color of the fabric and spaced so that visual monitoring of these colored fibers provides a means for controlling or preventing distortion of the fabric as it is stretched over a conventional silk-screen printing frame.

3 Claims, 5 Drawing Figures

COLOR-KEYED FABRIC FOR SCREEN PRINTING

BACKGROUND OF THE INVENTION

Silk-screen printing, more accurately designated "screen printing" has long been used to produce high quality illustrations although its method does not readily lend itself to high volume production. In the last decade, however, screen printing has had a resurgence in use for applications where long runs of high quality prints are desired, this resurgence being due to the use in the process of more complex, automatic equipment. Essentially, screen printing is a form of stencil printing using a design fashioned from paper, or other material, and attached to a woven sheet of fabric (silk, organdie, nylon or polyester fibers, copper, stainless steel strands, etc.) which has been tightly stretched across a frame. Ink is then forced through the open meshes of the fabric sheet by means of a rubber blade or squeege. The size of the opening in the mesh of the woven fabric, if formed of silk, might vary from 6xx (coarse) to 18xx (very fine). The mesh can also be achieved by etching a thin metal plate but more commonly is formed by a woven fabric. Pervading all screen printing applications, particularly where a flexible fabric is used, whether using high volume automated equipment or a simple rectangular printing frame, is the requirement that the woven fabric be fastened evenly and drum-tight to the frame. Since the woven fabric can easily be stretched, distorting and stretching the openings in the mesh, the even, drum-tight application of the woven fabric to the frame is not an easy task and requires skill and experience whether the mounting of the fabric is accomplished by mechanical apparatus or by simple tacking procedures. Further, different materials have differing optimum stretch characteristics for screen printing and the optimum degree of stretch is, customarily, recommended by the manufacturer or weaver of the material. Stretching of the material to the degree recommended by the manufacturer while maintaining the mesh square with the frame, both vertically and horizontally, is very difficult when the stretching of the fabric is done by hand. Since the mesh is very fine, use of a magnifying glass is often necessary to detect distortion of the mesh and this compounds the difficulty. Measuring the distance between the colored bands in the fabric of the present invention provides a convenient means for determining the proper amount of stretch imparted to the fabric. Any variation in the amount of pull exerted by the operator as he fastens the fabric to the frame causes the mesh to be wavy in appearance. While mechanical stretching apparatus gives improved results, even with such apparatus difficulties are encountered at the corners of the frame. The presence of the spaced, colored bands in the fabric of the present invention eases this difficulty.

Most materials used to form the mesh will shrink or stretch as ambient humidity and temperature vary. When mounted screens, with stencil attached, are stored or set aside even for a short time, if the mesh is not square with the frame, humidity or temperature change induced stretching or shrinking occurs on a bias causing mesh distortion. Detection and remedying this distortion is made easier by the presence of the horizontally and vertically spaced colored bands in the fabric.

The concept of the present invention envisages providing a woven fabric particularly adapted for silk screen printing in that it has groups of one or more adjacent vertical and horizontal threads provided with a color contrasting with the overall cover of the fabric. As the fabric is mounted on the frame, the rectilinearity of these contrastingly colored "stripes" in the fabric provide a convenient means for visually monitoring the condition of the fabric and preventing distortion and stretching of it as fastening or mounting proceeds.

DESCRIPTION OF THE PREFERRED EMBODIMENT

Figure 1:
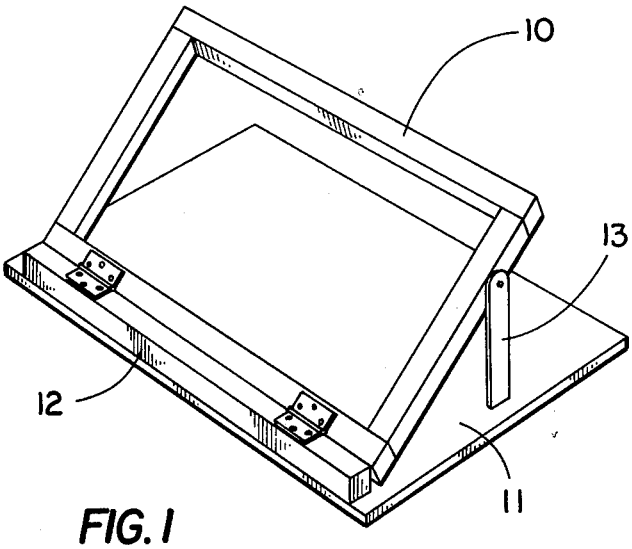
FIG. 1 is a perspective view of a conventional, silk screen printing frame and base.

Referring initially to FIG. 1, there is disclosed a conventional silk screen frame 10 and base 11, which may be formed of wood. The base carries a cleat 12 to which the frame is hinged, the hinge pins being removable so that the frame can be conveniently separated from and rejoined to the base. A releasable prop 13 selectively supports the frame at an angle to the base permitting access to the upper face of the base for placing and positioning of paper or other material which is to receive the printed image.

Figure 2:
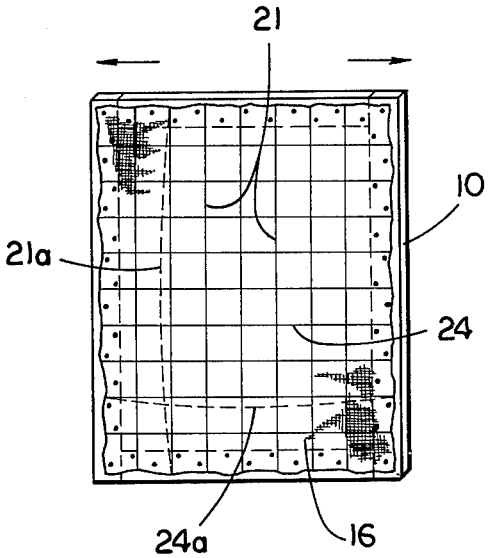
FIG. 2 is a perspective view of the frame component shown in FIG. 2 illustrating fastening, by tacking, of the fabric of the present invention on the frame.
Figure 4:
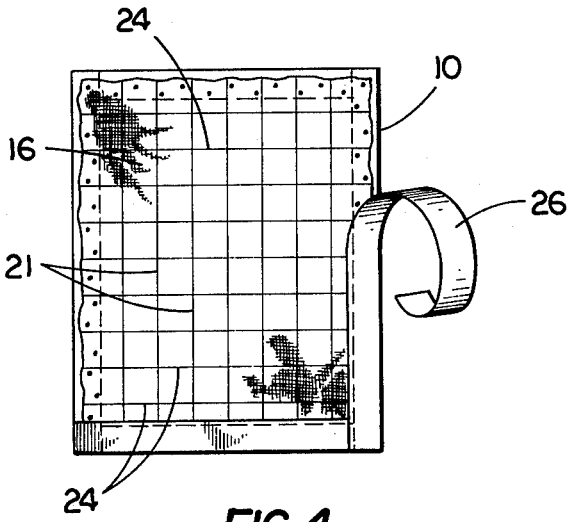
FIG. 4 is a perspective view similar to FIG. 2 but showing a further step in mounting the fabric.

As previously mentioned, stretching the fabric, whether of woven nylon or silk, on the frame so that it is even and drum-tight is of utmost importance. This is accomplished by separating the frame 10 from the base 11, and cutting a sheet of fabric approximately an inch larger than the outside dimension of the frame and finally tacking, stapling or otherwise securing the fabric to the frame. This process is illustrated in FIG. 2 in which the frame is placed on a rigid support surface with the hinge plates down. The fabric is then lined up on the frame with the vertical and horizontal threads of the fabric parallel with the sides of the frame. Tacking is started at the center of one of the long sides of the frame and proceeds outwardly the tacks being about 1 inch apart. The opposite side is then tacked and finally the ends, one after the other, with tacking proceeding from the center outward.

Figure 3:
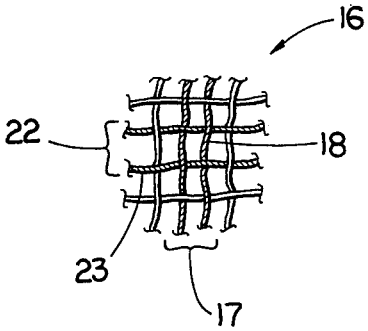
FIG. 3 is a fragmentary, enlarged view of silk screen fabric embodying the present invention.
Figure 5:
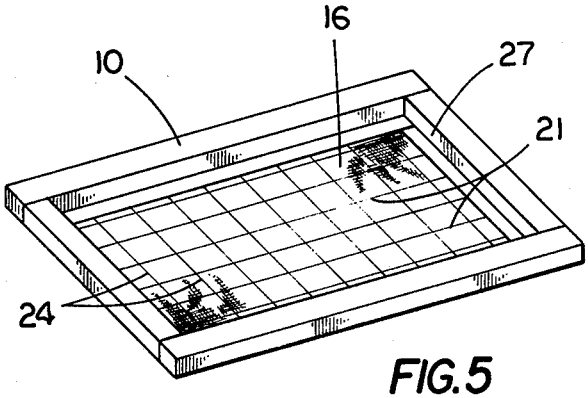
FIG. 5 is a perspective view of the frame of FIGS. 2 and 4 illustrating a further step in mounting the fabric on the frame.

During this fastening operation the fabric must be kept smooth and the horizontal and vertical threads of the fabric must be kept parallel to the sides of the frame. For fine mesh silk fabric (number 10 mesh to number 18xx mesh, for example) maintaining this rectilinearity of the threads is difficult. The fabric, embodying the present invention and shown in FIGS. 2, 3, 4 and 5, eases this difficulty. As may best be seen in FIG. 3, the woven fabric 16 has groups 17 of one or more (two as illustrated, for example) of adjacent vertical threads or fibers 18 which have a color contrasting with the overall, predominant color of the fabric. This results in a series of clearly visible, parallel, vertical "stripes" or lines 21 (FIG. 2) in the fabric. Similarly, referring again to FIG. 3, the woven fabric 16 has groups 22 of one or more (two being illustrated) of adjacent horizontal threads 23 which have a color contrasting with the overall, predominant color of the fabric, producing the horizontal "stripes" or lines 24 (FIG. 2). These rectilinear lines may, preferably, be separated by a distance of the order of 2 inches and provide a means for visually monitoring the fabric as it is being mounted on a printing frame. If the fabric threads are pulled out of a straight line configuration, as indicated, for example, by broken line 21*a* or 24*a* in FIG. 2, this will be clearly visible and proper adjustment of the fabric can be made.

The colored lines 21 and 24 are also useful in maintaining the undistorted condition of the fabric as kraft, adhesive tape 26 is placed over the fastener heads (FIG. 4) and as folded kraft adhesive tape 27 is applied to the edges where the fabric and the frame meet, this taping being a conventional part of the preparation of a silk screen frame. The colored lines in the fabric can result from utilizing colored threads or fibers in weaving the fabric or can be the result of printing the contrasting color on the surface of the fabric as long as the color medium is water resistant and not affected by the solvents in the inks or paints forced through the screen mesh.

As previously mentioned, the presence of the colored bands or "stripes" in the fabric of the present invention provide a means for visually monitoring the condition of the screen printing fabric, preventing distortion as the fabric is attached to the printing frame. The distance between the bands provides a means for measuring the stretching of the fabric on the frame so that it does not exceed the recommended value. The fabric attaching operation is thus made less dependent on the skill and experience of the operator. Distortion of the fabric on the frame because of ambient temperature or humidity change is easily detected.

While the invention has been illustrated and described in detail in the drawings and foregoing description, the same is considered as illustrative and not restrictive in character, it being understood that only the preferred embodiment has been shown and described and that changes and modifications that come within the scope of the invention are desired to be protected.

What is claimed is:

1. A mesh fabric for use in screen printing having threads or fibers uniformly spaced to provide a mesh screen through which printing ink is forced during the printing process, the fabric being secured evenly and drum-tight to a rigid printing frame and means for monitoring and thereby controlling distortion of the fabric as it is tightened over the frame, said means consisting of certain groups of one or more adjacent parallel fibers having a color contrasting with the overall color of the fabric and said colored groups of fibers being uniformly spaced from each other across the surface of the fabric, whereby the spacing between said colored groups of fibers may be visually monitored as the fabric is being secured to its printing frame.

2. A fabric for use in silk screen printing having continuous horizontal and vertical threads or fibers interwoven to provide a mesh screen through which printing ink is forced during the printing process, the fabric being secured evenly and drum-tight to a rigid printing frame and means for monitoring and thereby controlling distortion of the fabric as it is tightened over the frame, said means consisting of groups of one or more adjacent vertical and horizontal fibers having a color contrasting with the overall color of the fabric and the non-intersecting ones of said groups being uniformly spaced from each other across the surface of the fabric, whereby the rectilinearity of said contrasting color fibers may be visually monitored as the fabric is being secured to its printing frame.

3. A fabric as claimed in claim 2 in which the distance between parallel groups of said contrasting color fibers is of the order of 2 inches.

* * * * *